US011589440B1

(12) United States Patent
Marry

(10) Patent No.: US 11,589,440 B1
(45) Date of Patent: Feb. 21, 2023

(54) LED SWITCHING SYSTEM

(71) Applicant: Kenall Manufacturing Company, Kenosha, WI (US)

(72) Inventor: Patrick Marry, Hawthorn Woods, IL (US)

(73) Assignee: Kenall Manufacturing Company, Kenosha, WI (US)

( * ) Notice: Subject to any disclaimer, the term of this patent is extended or adjusted under 35 U.S.C. 154(b) by 0 days.

(21) Appl. No.: 17/559,446

(22) Filed: Dec. 22, 2021

Related U.S. Application Data

(60) Provisional application No. 63/231,163, filed on Aug. 9, 2021.

(51) Int. Cl.
*H05B 45/46* (2020.01)

(52) U.S. Cl.
CPC ..... *H05B 45/46* (2020.01)

(58) Field of Classification Search
CPC ..... H05B 45/30; H05B 45/46; H05B 47/10; H05B 47/21
See application file for complete search history.

(56) References Cited

U.S. PATENT DOCUMENTS

2015/0123550 A1 5/2015 Kunst et al.
2017/0231061 A1 8/2017 Deese et al.
2018/0159434 A1* 6/2018 Werner ..... H02M 3/33561
2018/0302966 A1* 10/2018 Xie ..... H05B 45/34
2019/0224350 A1 7/2019 Marry et al.

FOREIGN PATENT DOCUMENTS

KR 10-21011-0028204 3/2011
KR 10-2015-0047137 5/2015

OTHER PUBLICATIONS

International Search Report and Written Opinion, dated May 9, 2022, from the Korean Intellectual Property Office, in connection with the International Application No. PCT/US2021/064911.

* cited by examiner

*Primary Examiner* — Jimmy T Vu
(74) *Attorney, Agent, or Firm* — Christopher M. Scherer; DeWitt LLP

(57) ABSTRACT

The system of the present application is a switching system for LEDs which prevents breakdown of the system LED driver when switching between LEDs. The system switches between a first LED sting and a second LED string utilizing an LED driver, at least one LED module, a driver input, at least one pair of switching inputs and a switching module such that the first and second LED strings are activated by the switching module at all times, and each of the first and second LED strings operate with a driver output voltage within a voltage-current operating range of the LED driver. This allows the use of different sets of LEDs without requiring duplication of other system components.

20 Claims, 6 Drawing Sheets

LED SWITCHING SYSTEM

CROSS-REFERENCE TO RELATED APPLICATIONS

This application claims the benefit of prior-filed, U.S. Provisional Patent Applications No. 63/231,163, filed on Aug. 9, 2021, the contents of which are incorporated herein by reference in their entirety.

BACKGROUND OF THE INVENTION

The present disclosure is directed to a lighting system, more specifically to a system for switching light emitting diodes (LEDs), and strings of LEDs.

LED lighting systems provide inexpensive, reliable, and highly customizable lighting for many industries. LED lights can be used for simple illumination or functions such as, but not limited to, laboratory lighting, hospital operating rooms and Intensive Care units, environmental therapy or surface disinfection. Multiple applications are highly useful for areas which require normal white light illumination as well as some other benefits achieved through the use of narrower parts of the visible spectrum. These may include sterile environments, such as, but not limited to, medical manufacturing and food preparation facilities, surgical theaters and other medical spaces, and any other areas where biological contamination may be a problem. Another application is the use of red and near-infrared light therapy in the treatment of humans and animals.

One issue that arises with the dual use of LEDs in such situations is doses of light, whether UV, red, or near-infrared, may not be required on a continuous basis, or may be required at two separate dosing and/or power levels. As a result, many facilities have two separate LED systems: one for normal illumination (which may include a certain amount of disinfecting or therapeutic light), and one for another function, such as, but not limited to, continuous disinfection when the facility is unoccupied or administration of purely therapeutic light. As can be expected, this system duplication requires twice as much space to operate and costs more to install, both of which may be an issue when converting older facilities, building new facilities, or using the system in small areas.

While manufacturers have attempted to solve this problem by creating systems switchable between different sets of LEDs, this normally requires duplicate LED drivers inside the luminaire, switched on and off by removing the AC line voltage using a relay. Attempts to lower the cost and complexity by using a single LED driver with a switched DC output can result in the LED drivers inevitably shutting down at an early point in system life. Switching between multiple sets of LEDs using break-before-make components such as relays causes the LED drivers to lack an electrical load during the brief period between switching off one set of LEDs and switching on another. Protection circuits within the LED driver cause it to shut down in self-defense when this condition is present.

There is an unmet need in the art for a system capable of switching between different sets of LEDs without duplicating system components.

BRIEF SUMMARY

One embodiment of the present invention is a system for switching between a first LED string and a second LED string. The system includes an LED driver having a positive terminal and at least one LED module having at least one of the first and second LED strings, a driver input, and at least one of a pair of switching inputs. The driver input of the at least one LED module is connected to the positive terminal of the LED driver and the pair of switching inputs are connected to a switching module. At least one of the first LED string and the second LED string is activated by the switching module at all times. Each of the first and second LED strings operates with a driver output voltage within a voltage-current operating range of the LED driver.

Another embodiment of the present invention is a system for switching between a first LED string and a second LED string. The system includes an LED driver having a positive terminal, and at least one LED module having a driver input and at least one of a pair of switching inputs. The driver input of the at least one LED module is connected to the positive terminal of the LED driver and the pair of switching inputs are connected to a switching module. The switching module switches between activation of the first LED string and activation of the second LED string such that the first LED string and the second LED string are active simultaneously when switching between the first LED string and the second LED string and when switching between the second LED string and the first LED string.

BRIEF DESCRIPTION OF THE DRAWING(S)

Figure 1:
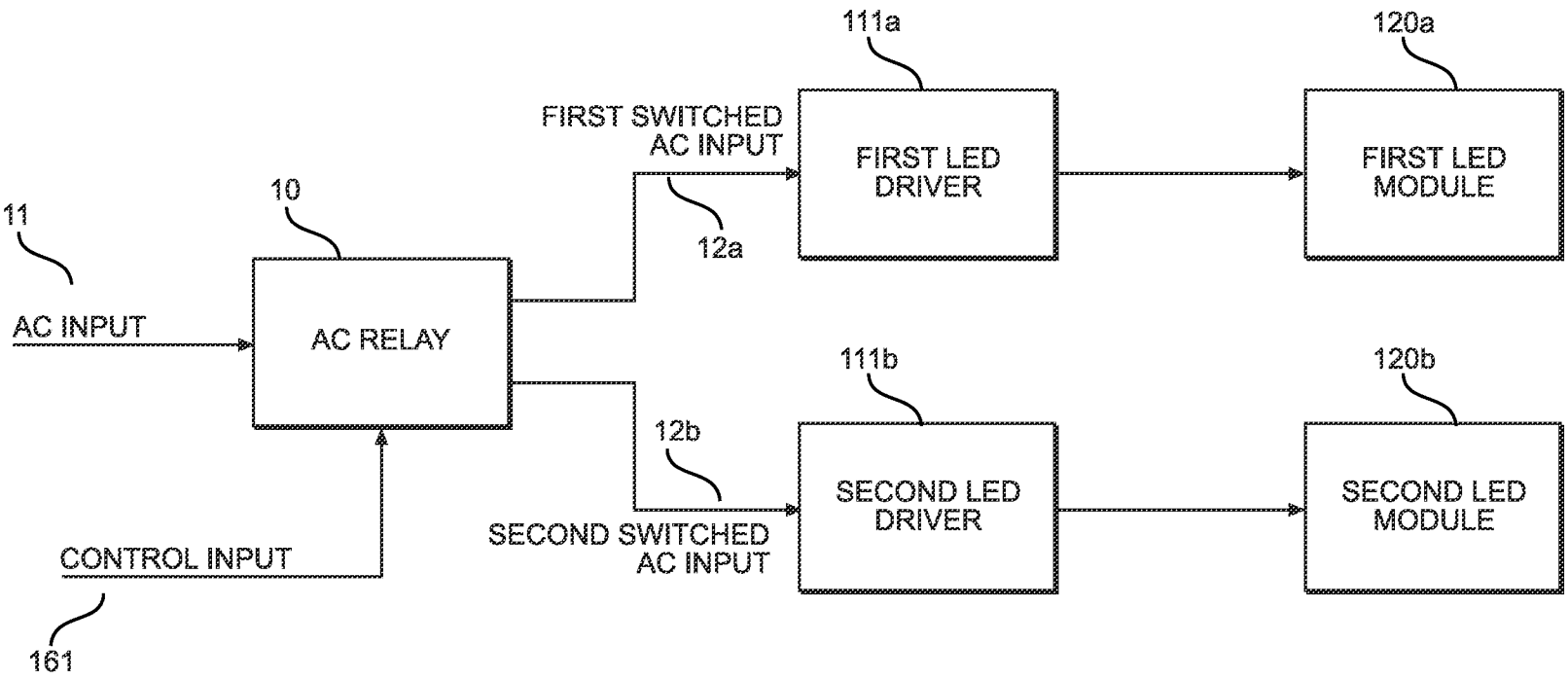
FIG. 1 PRIOR ART
FIG. 1 is a system diagram of an exemplary embodiment of a prior art LED luminaire system incorporating multiple LED modules, switchable using an external control input and a relay.

It should be understood that for clarity, not every part is labeled in every drawing. Lack of labeling should not be interpreted as a lack of disclosure.

DETAILED DESCRIPTION OF THE INVENTION

In the present description, certain terms have been used for brevity, clearness and understanding. No unnecessary limitations are to be applied therefrom beyond the requirement of the prior art because such terms are used for descriptive purposes only and are intended to be broadly construed. The different systems and methods described herein may be used alone or in combination with other systems and methods. Dimensions and materials identified in the drawings and applications are by way of example only and are not intended to limit the scope of the claimed invention. Any other dimensions and materials not consistent with the purpose of the present application can also be used. Various equivalents, alternatives and modifications are possible within the scope of the appended claims. Each limitation in the appended claims is intended to invoke interpretation under 35 U.S.C. § 112, sixth paragraph, only if the terms "means for" or "step for" are explicitly recited in the respective limitation.

The exemplary LED system shown in FIG. 1 is representative of prior art implementations and includes an AC relay 10 with AC input 11 providing electrical power to the entire system. The AC input 11 which provides power is switched by AC relay 10 under control of control input 161, generating a pair of switched AC outputs, 12*a* and 12*b*. Only one of the AC outputs 12*a* or 12*b* is active at any given time. Switched AC output 12*a* powers LED driver 111*a* which then provides DC power to LED module 120*a*.

Switched AC output 12*b* powers LED driver 111*b* which then provides DC power to LED module 120*b*. LED driver 111*a* and LED driver 111*b* are never powered at the same time since AC relay 10 generates only one switched AC output 12*a* or 12*b* at a time. Only one LED module, either 120*a* or 120*b*, is illuminated at any given time. While this method is effective, it is undesirably costly and consumes additional space since it incorporates a pair of LED drivers, 111*a* and 111*b*.

Figure 2:
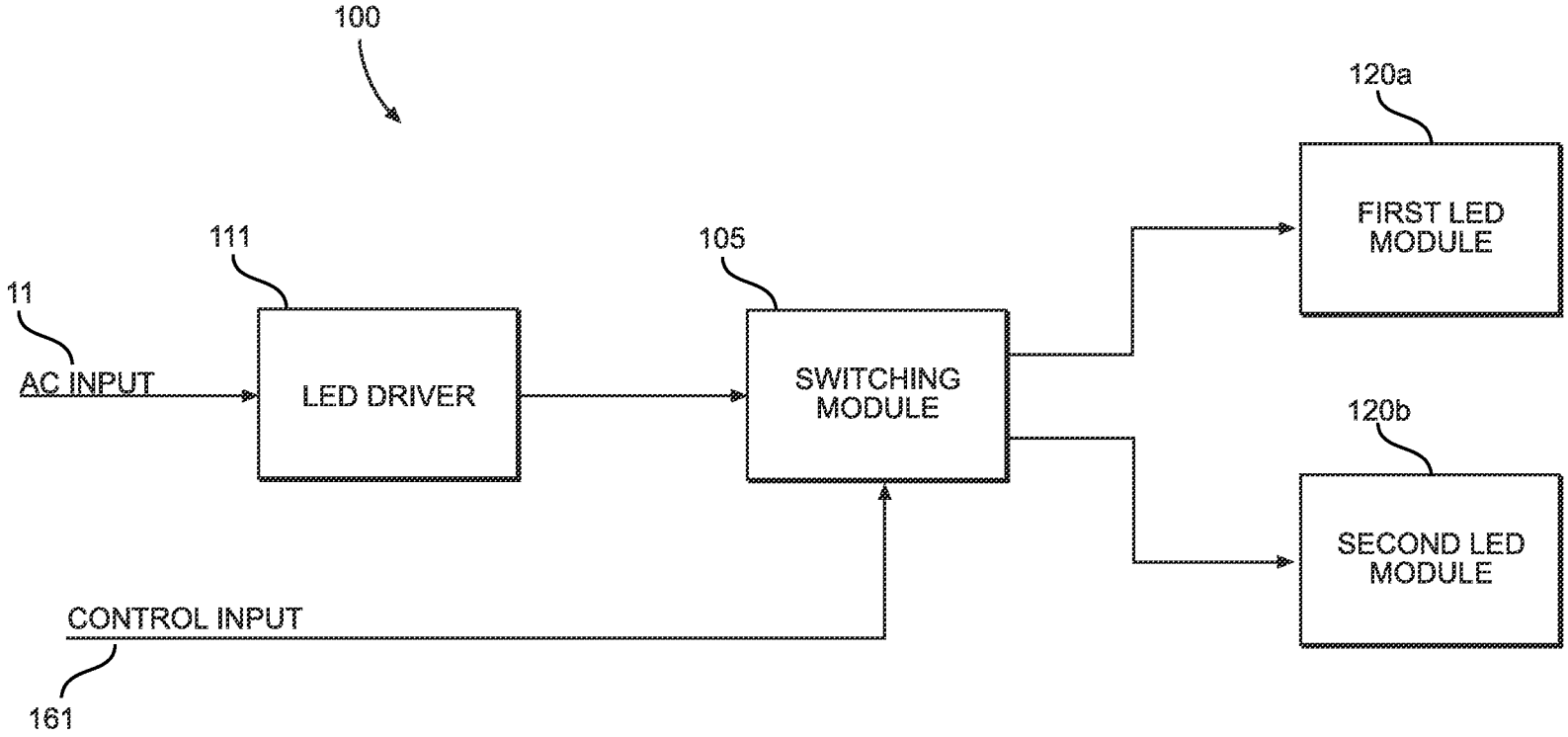
FIG. 2 is a system diagram of an exemplary embodiment of an LED luminaire system incorporating multiple LED modules with an exemplary LED switching system.

The exemplary LED system 100 shown in FIG. 2 describes the present invention incorporating multiple LED modules 120*a* and 120*b* and using a single LED driver 111 whose output is switched between LED modules 120*a* and 120*b* using a switching module 105. Another embodiment shown in FIG. 3 includes a single LED module 120*a* with multiple independent LED strings 123*a* and 123*b*, again using a single LED driver 111 whose output is switched between LED strings 123*a* and 123*b* using the switching module 105. In either embodiment, only a single LED driver 111 is used, reducing cost, complexity and size. The same switching module 105 may be used with either of the embodiments of FIG. 2 or FIG. 3, whether using multiple switchable LED modules 120*a* and 120*b*, or multiple switchable LED strings 123*a* and 123*b* in a single LED module 120*a*.

Figure 3:
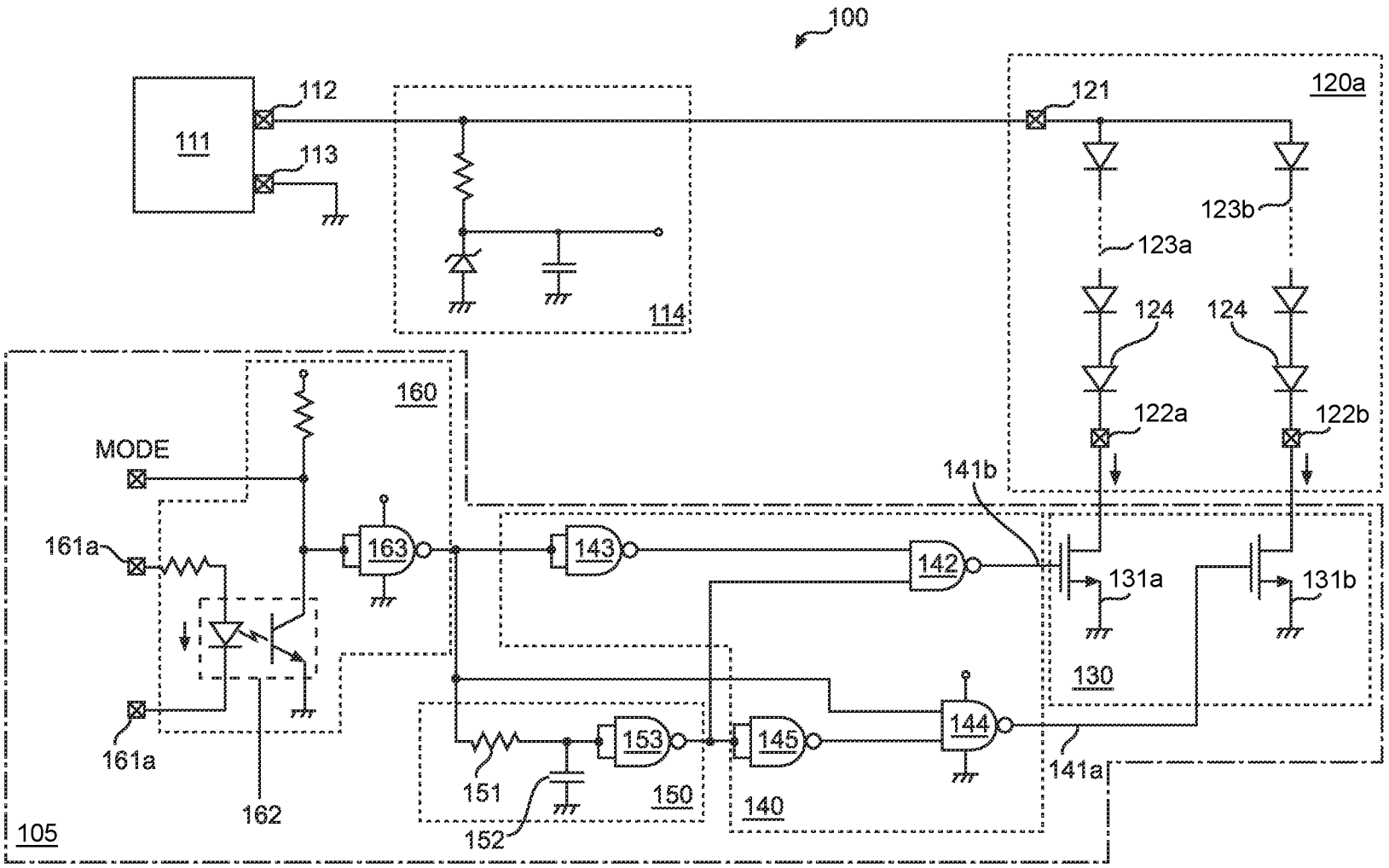
FIG. 3 is a system diagram of an exemplary embodiment of an LED switching system.

The LED driver 111, as shown in FIG. 3, has a unique characteristic known as constant current, constant voltage. In other words, the current supplied by the LED driver 111 to the LED module 120*a* will remain constant as long as the voltage is within the voltage-current operating range of the LED driver 111.

The positive terminal 112 of the LED driver 111 connects to a power subsystem 114 and to the driver input node 121 of the LED module 120*a*. The negative terminal 113 of the LED driver 111 connects to ground. The power subsystem 114 provides necessary voltages for all other subsystems in the switching module 105.

The LED module 120*a* shown in FIG. 3 is a removable and replaceable module which includes the LEDs 124 used to supply light. While the exemplary embodiment shows a single LED module 120*a* switching between multiple LED strings 123*a* and 123*b*, other embodiments may switch between multiple LED modules 120*a* and 120*b*, as shown in FIG. 2.

Figure 6:
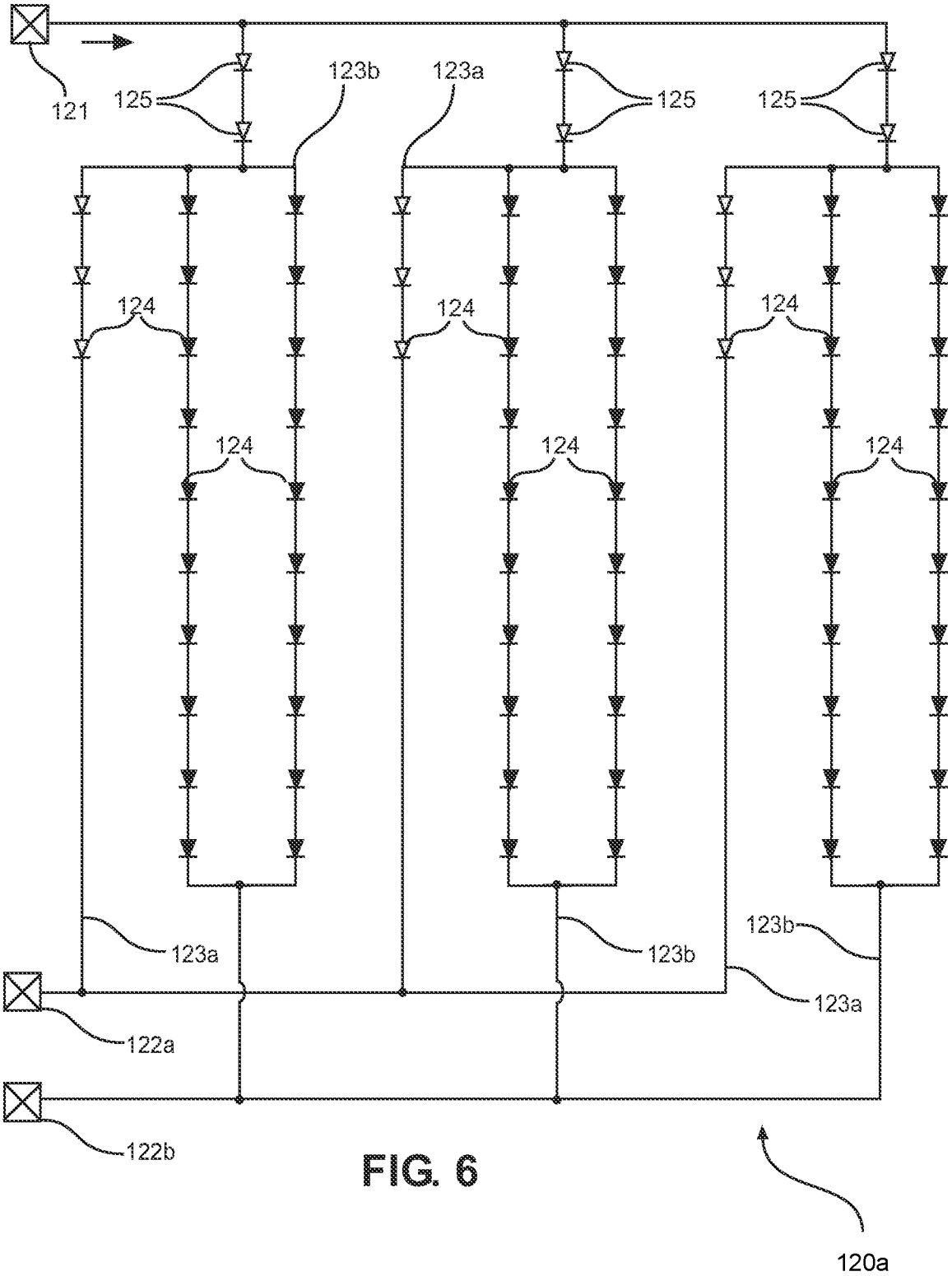
FIG. 6 is a system diagram of another embodiment of an LED module with partially parallel strings of LEDs.

The driver input node 121 of the LED module 120*a* connects to the positive terminal 112 of the LED driver 111. In the exemplary embodiment this signal passes directly through the switching module 105. The LED module 120*a* comprises at least one LED string 123*a* extending at least partially or entirely in parallel from the driver input node 121. The exemplary embodiment shown in FIG. 3 contains two LED strings 123*a* and 123*b* extending entirely in parallel. Each LED string 123*a* and 123*b* includes at least one LED 124 or a plurality of LEDs 124 in series. In embodiments with partially parallel LEDs 124, at least one shared LED 125 may be a part of both LED strings 123*a* and 123*b*. Such shared LEDs 125 will be constantly active. In the exemplary embodiment shown in FIG. 6, an LED string 123*a* of a series of blue LEDs 124 "shares" two blue shared LEDs 125 with an LED string 123*b* of a series of otherwise-white LEDs 124. As a result, the blue shared LEDs 125 will be active during activation of either LED string 123*a* or 123*b*.

The number of LEDs 124 and shared LEDs 125 in each LED string 123*a* and 123*b*, including shared LEDs 125 which are a part of both LED strings 123*a* and 123*b*, may include any number of LEDs 124 and shared LEDs 125 which can be accommodated by the operating range of the LED driver 111 as discussed below. It should be understood that while the term "strings" is used to describe the arrangement of LEDs 124 and shared LEDs 125, the present embodiment contemplates that an LED string may comprise any configuration of LEDs 124 and shared LEDs 125 in series and/or parallel.

Figure 5:
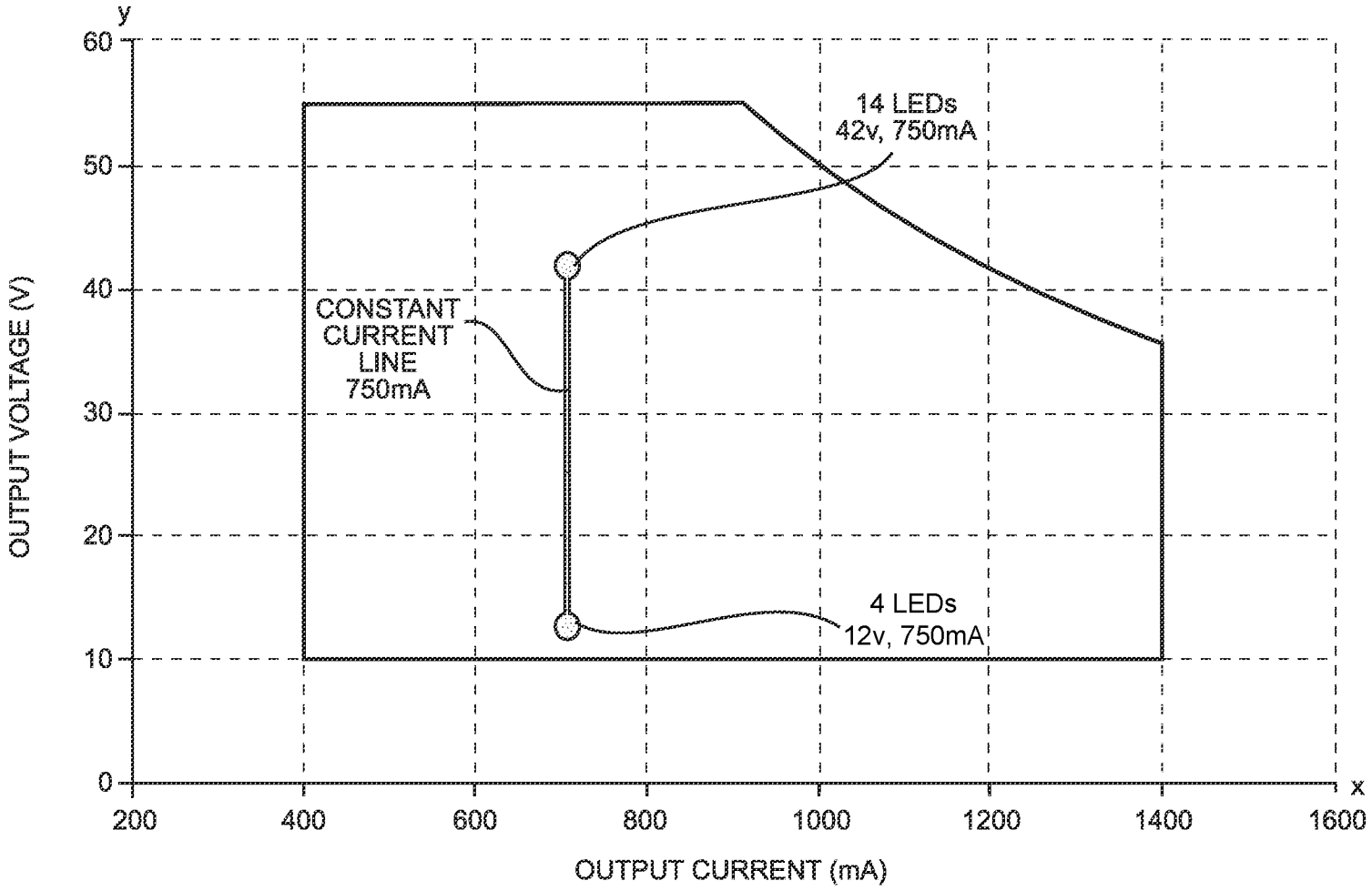
FIG. 5 is a diagram of the output voltage and current range of an exemplary LED driver.

FIG. 5 shows a graph of the operating range of an exemplary LED driver 111. The output current (mA) is shown on the x-axis, while the output voltage (V) is shown on the y-axis. The operating range for the LED driver 111 is bounded by the solid line. As shown in FIG. 5, the LED driver 111 may operate over a range of 10 V to 55 V at a current ranging from 400 mA to 900 mA, with the maximum voltage steadily decreasing to 35 V over a range from 900 mA to 1400 mA. The LEDs 124 and shared LEDs 125 of the exemplary embodiment have an operating voltage of 3 V, allowing for each LED string 123*a* and 123*b* to include anywhere from 4 to 18 LEDs 124 and shared LEDs 125 at a current of 750 mA.

The output voltage of the LED driver 111 is equal to a given number of volts per LED to ensure a constant current flow through each LED string 123*a* and 123*b*. As a result, the output voltage will change when switching between LED strings 123*a* and 123*b* with differing numbers of LEDs 124 and shared LEDs 125 and/or LEDs 124 and shared LEDs 125 with different voltage characteristics. The number and voltage characteristics of LEDs 124 and shared LEDs 125 in each LED string 123*a* and 123*b* will be selected to stay within the voltage-current operating range of the LED driver 111. FIG. 5 shows an example of a constant current of 750 mA, switching between two different voltages: 42 V for an LED string 123*a* of 14 LEDs 124 and 15 V for an LED string 123*b* of 5 LEDs 124. This constant current, constant voltage output characteristic is shown to be within the exemplary operating range of the exemplary LED driver 111 in FIG. 5.

The switching module 105 shown in FIG. 3 comprises an output subsystem 130, a signal generation subsystem 140, a delay subsystem 150, and a buffer subsystem 160. Each LED string 123*a* and 123*b* terminates in an on-off switch 131*a* and 131*b* in the output subsystem 130. In the exemplary embodiment, each on-off switch 131*a* and 131*b* is a field-effect transistor. The on-off switches 131*a* and 131*b* receive the pair of signal outputs 141*a* and 141*b* of the switching module 105, and feed into the respective switching inputs 122*a* and 122*b* of the LED module 120*a*. In embodiments with multiple LED modules 120*a* and 120*b*, the switching inputs 122*a* and 122*b* are located in separate LED modules 120*a* and 120*b*, respectively. In embodiments with a single LED module 120*a*, both switching inputs 122*a* and 122*b* are a part of the LED module 120*a*.

The signal generation subsystem 140 creates overlapping signal outputs 141*a* and 141*b* to drive the LED strings 123*a* and 123*b*. This guarantees that the LED driver 111 always has an electrical load. Each signal output 141*a* and 141*b* is connected to one of the on/off switches in the output subsystem 130.

The first signal output 141*b* is the output of a first signal generation subsystem NAND logic gate 142. The first input of the first signal generation subsystem NAND logic gate 142 is the output of a first inverting NAND logic gate 143. The second input of the first signal generation subsystem NAND logic gate 142 is the output of the delay subsystem 150. Both inputs of the first inverting NAND logic gate 143 inverter are the output of the buffer subsystem 160.

The second signal output 141*a* is the output of a second signal generation subsystem NAND logic gate 144. The first input of the second signal generation subsystem NAND logic gate 144 is the output of the buffer subsystem 160. The second input of the second signal generation subsystem NAND logic gate 144 is the output of a second inverting NAND logic gate 145. Both inputs of the second inverting NAND logic gate 145 are the output of the delay subsystem 150.

The first signal generation subsystem NAND logic gate 142 receives a mode input and a delay input. The second signal generation subsystem NAND logic gate 144 receives an inverted mode input and an inverted delay input.

Figure 4:
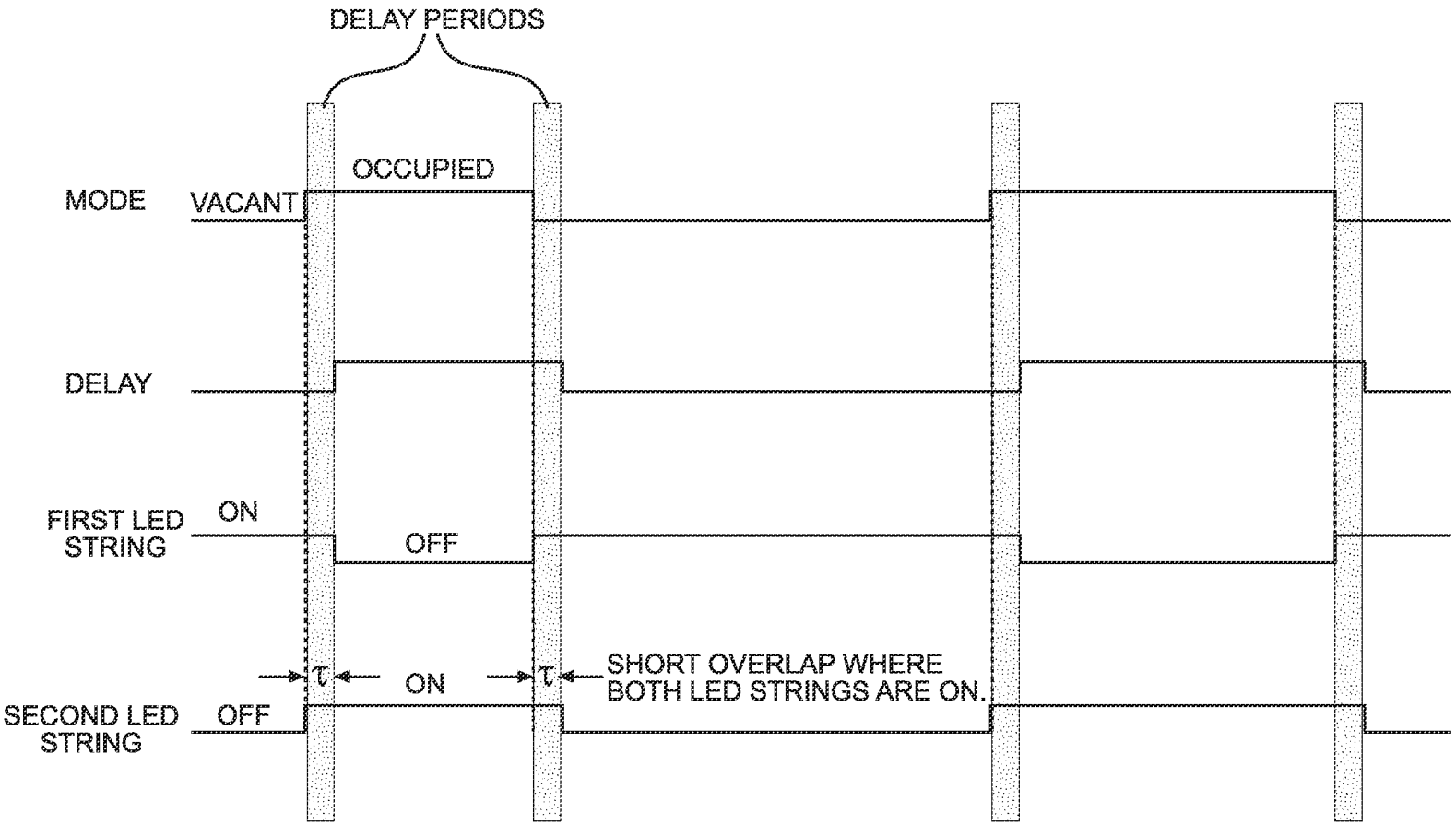
FIG. 4 is a system state diagram showing the mode and delay signals and activation states of different sets of LEDs in the exemplary LED switching system over time.

As can be seen in FIG. 4, while still referring to FIG. 3, the delay subsystem 150 delays both the rising and falling edges of the mode signal to create the delay signal input. Switching between LED strings 123*a* and 123*b* must include a delay so that the falling edge of the off-going LED string overlaps with the rising edge of the on-coming LED string. This ensures that the LED driver 111 does not shut off as it always has an electrical load due to providing power to at least one LED string 123*a* or 123*b*. Because the current is constant, the LEDs 124 in both LED strings 123*a* and 123*b* will dim slightly during the overlap period. In the exemplary embodiment, the delay subsystem 150 generates a delay of approximately 100 milliseconds (ms). Because the overlap period is in the range of milliseconds in the exemplary embodiment, this dimming period will not be apparent to a user.

The delay subsystem 150 receives an output from the buffer subsystem 160 which passes through a delay resistor 151. The delay resistor 151 output is connected to a delay capacitor 152 leading to ground and to both inputs of a delay signal NAND logic gate 153. Selection of the resistance and capacitance of the respective components creates the resultant delay based on the R*C value.

The buffer subsystem 160 buffers the incoming occupancy signal. The positive and negative occupancy terminals 161*a* and 161*b* are connected to an optocoupler circuit 162. In the exemplary embodiment, the optocoupler circuit 162 comprises a resistor in series with a diode extending between the positive and negative occupancy terminals 161*a* and 161*b*, and coupled to a transistor. The optocoupler circuit 162 is arranged such that no current signals an occupied state. The output of the optocoupler circuit 162 is connected to both inputs of a buffering NAND logic gate 163. The output of the buffer subsystem 160 is the output of the buffering NAND logic gate 163. This output forms the input of the delay subsystem 150, the first inverting NAND logic gate 143, and the second signal generation subsystem NAND logic gate 144.

The NAND logic gates used in the present application are standard NAND logic gates connected to the power subsystem 114 and a ground.

It is to be understood that this written description uses examples to disclose the invention, including the best mode, and also to enable any person skilled in the art to make anew the invention. The patentable scope of the invention may include other examples that occur to those skilled in the art.

What is claimed is:

1. A system for switching between a first LED string and a second LED string, the system comprising:

an LED driver comprising a positive terminal; and at least one LED module comprising at least one of the first LED string and at least one of the second LED string, a driver input, and at least one of a pair of switching inputs, the driver input of the at least one LED module being connected to the positive terminal of the LED driver and the at least one of the pair of switching inputs being connected to a switching module, wherein at least one of the first LED string and at least one of the second LED string is activated by the switching module at all times, wherein each of the first LED string and the second LED string operates with a driver output voltage within a voltage-current operating range of the LED driver.

2. The system of claim 1, wherein the switching module comprises an output subsystem, a signal generation subsystem, a delay subsystem, and a buffer subsystem.

3. The system of claim 2, wherein the output subsystem comprises a first input and a second input, and a pair of outputs connected to the pair of switching inputs.

4. The system of claim 3, wherein the signal generation subsystem comprises a first pair of inputs and a first signal output and a second pair of inputs and a second signal output.

5. The system of claim 4, wherein the first input of the output subsystem is connected to the first output of the signal generation subsystem, and the second input of the output subsystem is connected to the second output of the signal generation subsystem.

6. The system of claim 5, wherein the delay subsystem comprises an input and an output.

7. The system of claim 6, wherein one of the first pair of inputs of the signal generation subsystem and one of the second pair of inputs of the signal generation subsystem are connected to the output of the delay subsystem.

8. The system of claim 7, wherein the buffer subsystem comprises an input and an output.

9. The system of claim 8, wherein another of the first pair of inputs of the signal generation subsystem and another of the second pair of inputs of the signal generation subsystem are connected to the output of the buffer subsystem.

10. The system of claim 2, wherein the output subsystem further comprises a first on-off switch connected to the first LED string and a second on-off switch connected to the second LED string.

11. The system of claim 2, wherein a first signal output of the signal generation subsystem comprises an output of a first signal generation subsystem NAND logic gate receiving an output of a first inverting NAND logic gate and an output of the delay subsystem, wherein a first and second input of the first inverting NAND logic gate inverter are an output of the buffer subsystem.

12. The system of claim 2, wherein a second signal output of the signal generation subsystem is an output of a second signal generation subsystem NAND logic gate, wherein a first input of the second signal generation subsystem NAND logic gate is an output of the buffer subsystem and a second input of the second signal generation subsystem NAND logic gate is an output of a second inverting NAND logic gate, wherein a first and second input of the second inverting NAND logic gate are an output of the delay subsystem.

13. The system of claim 2, wherein the delay subsystem further comprises a delay resistor receiving an output of the buffer subsystem, wherein an output of the delay resistor is connected to a delay capacitor leading to ground and to a first and second input of a delay signal NAND logic gate.

14. The system of claim 2, wherein the buffer subsystem further comprises a positive occupancy terminal and a negative occupancy terminal connected to an optocoupler circuit, wherein an output of the optocoupler circuit is connected to a first and second input of a buffering NAND logic gate to produce an output of the buffer subsystem.

15. A system for switching between a first LED string and a second LED string, the system comprising:

an LED driver comprising a positive terminal; and at least one LED module comprising at least one of the first LED string and at least one of the second LED string, a driver input, and at least one of a pair of switching inputs, the driver input of the at least one LED module being connected to the positive terminal of the LED driver and the at least one of the pair of switching inputs being connected to a switching module, wherein the switching module switches between activation of the first LED string and activation of the second LED string such that the first LED string and the second LED string are active simultaneously when switching from the first LED string to the second LED string and when switching from the second LED string to the first LED string.

16. The system of claim 15, wherein the first LED string and the second LED string draw a constant current.

17. The system of claim 15, wherein the at least one LED module comprises both the first LED string and the second LED string.

18. The system of claim 15, wherein the at least one LED module comprises a first LED module and a second LED module, wherein the first LED module comprises the first LED string, and the second LED module comprises the second LED string.

19. The system of claim 15, wherein the first LED string comprises at least one LED and the second LED string comprises at least one LED.

20. The system of claim 15, wherein at least one LED is common to both the first LED string and the second LED string.

* * * * *